US008307948B2

(12) United States Patent
Parodi

(10) Patent No.: US 8,307,948 B2
(45) Date of Patent: Nov. 13, 2012

(54) SILENCER DEVICE FOR A HAIR DRYER

(75) Inventor: Paolo Parodi, Milan (IT)

(73) Assignee: Parlux S.p.A., Trezzano sul Naviglio (IT)

( * ) Notice: Subject to any disclaimer, the term of this patent is extended or adjusted under 35 U.S.C. 154(b) by 0 days.

(21) Appl. No.: 13/164,360

(22) Filed: Jun. 20, 2011

(65) Prior Publication Data

US 2012/0024620 A1 Feb. 2, 2012

(30) Foreign Application Priority Data

Jul. 29, 2010 (IT) ..... MO2010A0221

(51) Int. Cl.
*F01N 1/24* (2006.01)

(52) U.S. Cl. ..... 181/258; 34/96; 34/97; 34/99; 181/212; 392/384; 392/385

(58) Field of Classification Search ..... 181/258, 181/212; 34/96, 97, 99; 392/384, 385
See application file for complete search history.

(56) References Cited

U.S. PATENT DOCUMENTS 3,383,700 A * 5/1968 Taylor ..... 34/99
3,397,463 A * 8/1968 Laing ..... 34/97
3,818,600 A * 6/1974 Fischer ..... 34/99
4,025,223 A * 5/1977 Anders et al. ..... 415/53.1
4,596,921 A * 6/1986 Hersh et al. ..... 392/385
4,658,511 A * 4/1987 Mahlich et al. ..... 34/97
4,678,410 A * 7/1987 Kullen ..... 417/423.1
5,433,017 A * 7/1995 Brauchli et al. ..... 34/82
5,467,540 A * 11/1995 Bastien ..... 34/97
5,490,336 A * 2/1996 Smick et al. ..... 34/97
5,810,911 A * 9/1998 Behrendt et al. ..... 95/278
5,875,562 A * 3/1999 Fogarty ..... 34/97
6,011,903 A * 1/2000 Nosenchuck ..... 392/385
6,148,537 A * 11/2000 Altamore ..... 34/97
6,212,790 B1 * 4/2001 Stetson ..... 34/97
6,367,162 B2 * 4/2002 Fukumoto et al. ..... 34/97
6,393,208 B1 * 5/2002 Nosenchuck ..... 392/384
6,829,805 B2 * 12/2004 Yang ..... 15/347

(Continued)

FOREIGN PATENT DOCUMENTS

DE 8805910 U1 6/1988

(Continued)

*Primary Examiner* — David Warren
*Assistant Examiner* — Christina Russell
(74) *Attorney, Agent, or Firm* — Pearne & Gordon LLP

(57) ABSTRACT

A silencer device for a hair dryer comprises a container structure (2) exhibiting a plurality of inlet openings (8), an outlet opening (9) and a conduit (10) connecting the inlet (8) and outlet (9) openings to one another and further comprising a ring (14) made of sound-absorbent material, inserted in the conduit (10) such as to interfere with a flow of air between the inlet openings (8) and the outlet (9) opening in such a way as to at least partly attenuate sound vibrations associated to the air flow. The inlet openings (8) are made on a lateral wall (6) of the container structure (2) and face the axis (X) such as to define an air flow along a first transversal direction to the axis (X) such as to define a flow of air along a first transversal direction to the axis (X), and deviating means (12) arranged in the conduit (10) impress an axial deviation along the axis (X) on the air flow coming from the inlet openings (8).

16 Claims, 14 Drawing Sheets

U.S. PATENT DOCUMENTS

| | | | | |
|---|---|---|---|---|
| 6,868,579 | B2 * | 3/2005 | Yang | 15/347 |
| 2002/0073573 | A1 * | 6/2002 | Wu | 34/97 |
| 2003/0079366 | A1 * | 5/2003 | Chang | 34/96 |
| 2003/0116377 | A1 * | 6/2003 | Huhn et al. | 181/202 |
| 2006/0254073 | A1 * | 11/2006 | Zhen | 34/96 |
| 2007/0294909 | A1 * | 12/2007 | Abdi et al. | 34/97 |
| 2009/0188126 | A1 * | 7/2009 | Gaillard et al. | 34/97 |
| 2011/0010958 | A1 * | 1/2011 | Clark et al. | 34/97 |
| 2011/0016737 | A1 * | 1/2011 | Gaillard et al. | 34/97 |
| 2011/0203128 | A1 * | 8/2011 | Rodrigues | 34/96 |

FOREIGN PATENT DOCUMENTS

| | | | |
|---|---|---|---|
| EP | 2327327 | A1 * | 6/2011 |
| WO | 2010045698 | A1 | 4/2010 |

* cited by examiner

Fig.3
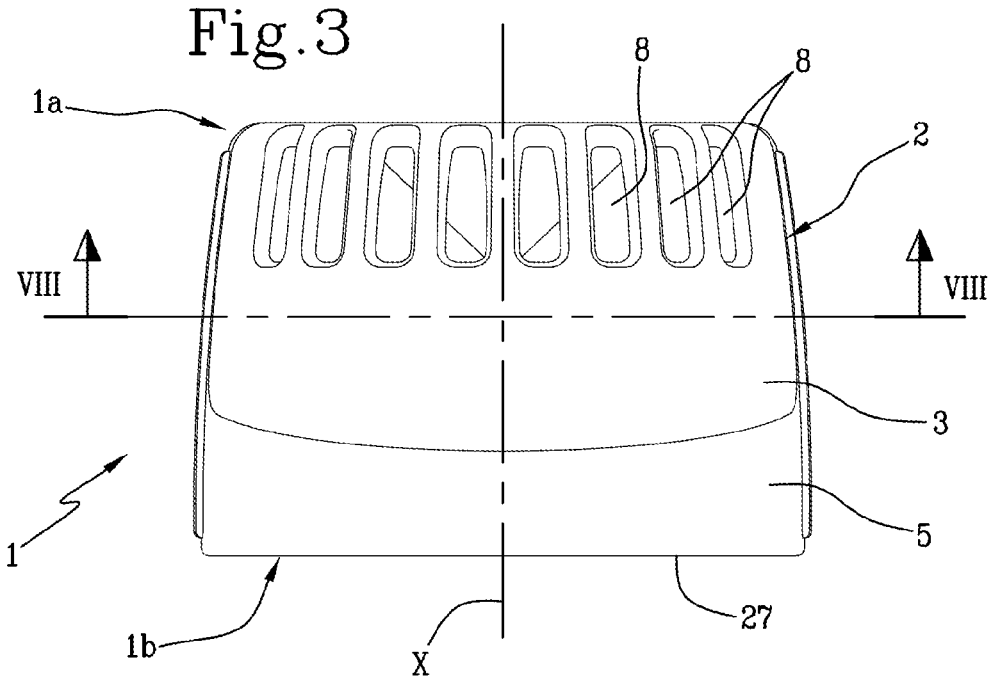
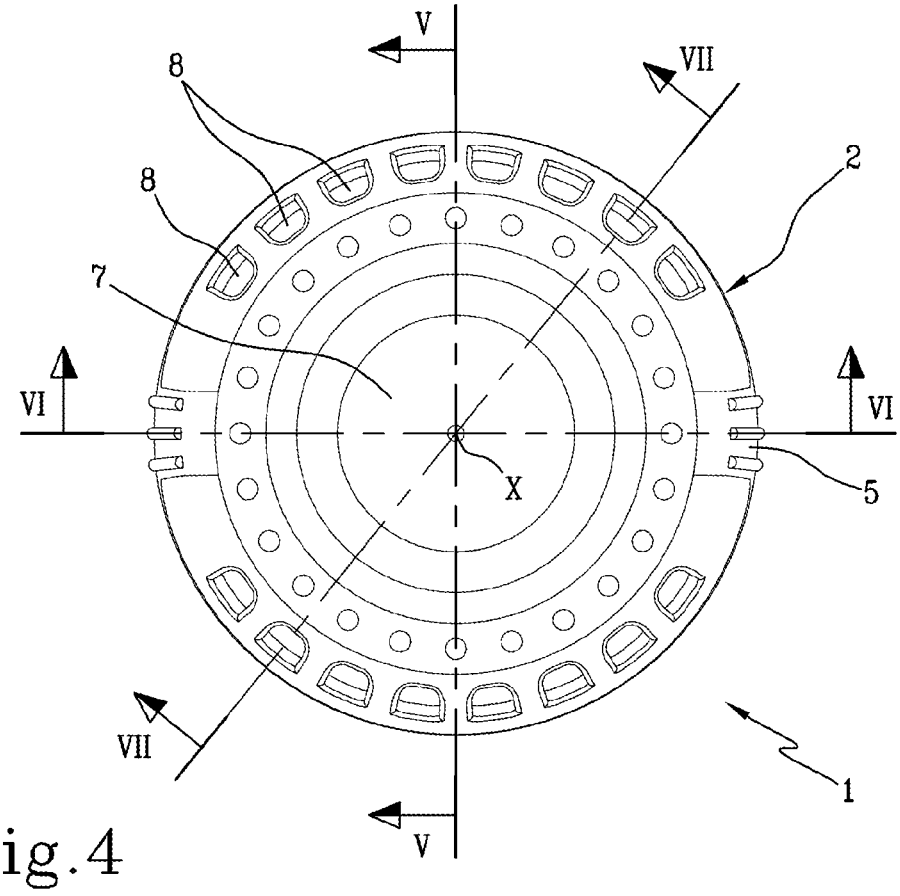
Fig.4

Fig.12
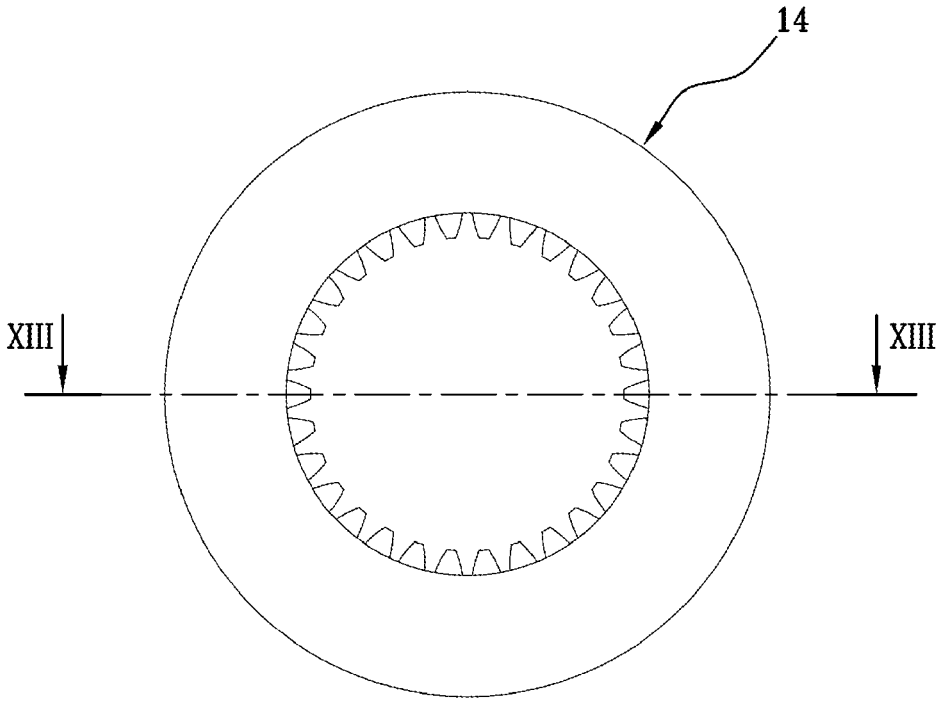
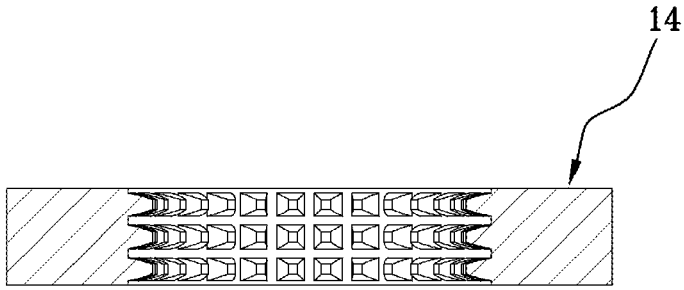
Fig.13

Fig.14
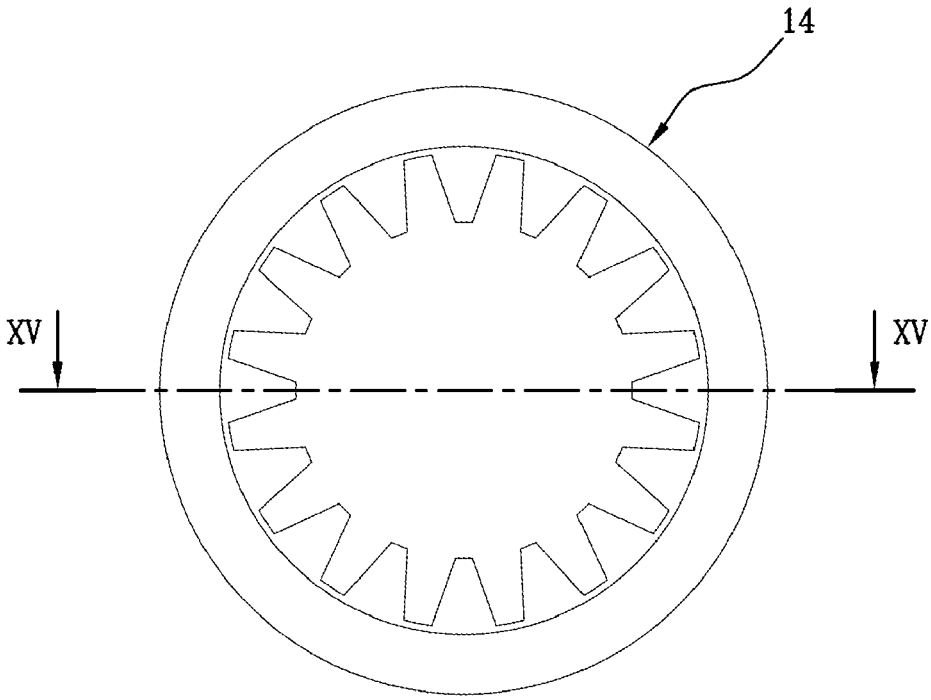
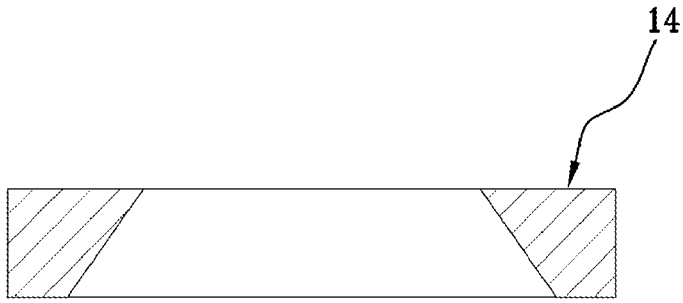
Fig.15

SILENCER DEVICE FOR A HAIR DRYER

FIELD OF THE INVENTION

The present invention relates to a silencer device for a hair dryer.

DESCRIPTION OF RELATED ART

Silencer devices for hair dryers are currently known which are applicable to the aspirating grid of a hair dryer such as to realise a particular treatment of the air flow entering with the aim of reducing the noise emitted during the functioning of the hair dryer.

These known silencer devices exhibit an inlet section and an outlet section, both axially aligned with respect to the aspiration direction of the hair dryer fan, and further exhibit annular zones lined with a sound-absorbent material, interposed between the inlet and outlet sections.

The air flow, entrained by the fan of the hair-dryer and forced to pass through the above-mentioned lined zones, is filtered of the sound frequencies by the lined zones, with a reduction of the overall sound emitted.

The lined zones are realised with toroidal bodies having a generally rectangular section.

The Applicant has however established that the silencer devices of known type are further improvable, especially due to the fact that they absorb an excessive quantity of power, caused by load losses in connection with the passage of air across the silencer devices.

Further, the sound-reduction effect is susceptible to further improvement. It is worthy of consideration that the silencer devices are generally applied to hair-dryers of a professional type, which are used by specialised personnel who make considerable use of them for many hours during the course of a day. It is therefore clear that the noise produced by the hair-dryer constitutes a source of disturbance, if not indeed a relevant problem in the work activity of the workers, and thus an improvement of the sound-reducing capacity of the silencer device might notably improve the working conditions, especially over a long period.

In this context, the technical aim at the base of the present invention is to provide a silencer device for hair-dryers which obviates the drawbacks of the above-cited prior art.

In particular, an aim of the present invention is to make available a silencer device for hair dryers which realises a high level of sound absorbance connected to noise and, therefore, a high level of sound-attenuating of the hair dryer.

A further aim of the present invention is to provide a silencer device for hair dryers which exhibits a low absorbance of power related to the sound-proofing produced.

SUMMARY OF THE INVENTION

The set technical task and the set aims are substantially attained by a silencer device for hair dryers comprising the technical characteristics set out in one or more of the accompanying claims.

BRIEF DESCRIPTION OF THE DRAWINGS

Further characteristics and advantages of the present invention will more clearly emerge from the indicative description, provided by way of non limiting example, of a preferred though not exclusive embodiment of a silencer device for hair-dryers, as illustrated in the accompanying figures of the drawings, in which:

FIG. 3 is a lateral view of the device of FIG. 1;

FIG. 4 is a plan view of the device of FIG. 1;

FIGS. 12 and 14 are two further embodiments of the ring 14 made of sound-proofing material;

FIGS. 13 and 15 show two sections along diameter planes respectively of FIGS. 12 and 14;

DETAILED DESCRIPTION OF THE INVENTION

In accordance with the accompanying figures, 1 denotes in its entirety a silencer device according to the present invention.

Figure 1:
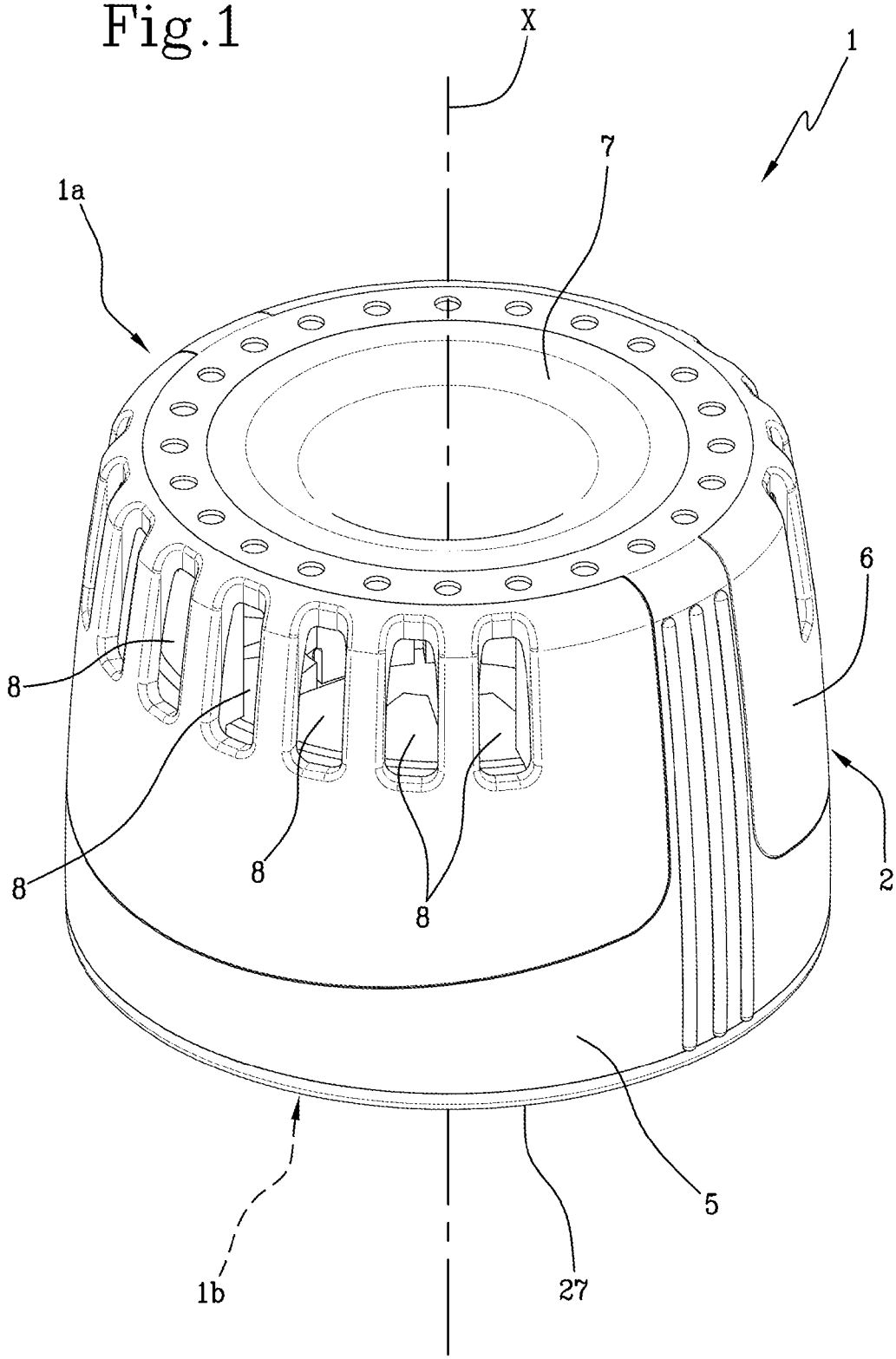
FIG. 1 is a perspective view of a silencer device according to the present invention.

As can be seen in FIG. 1, the silencer device 1 has a substantially cylindrical, or slightly tapered, external form, defining a sort of trunco-conical shape, closed at a first end 1*a* (visible in FIG. 1) and open at the other end 1*b* (hidden in FIG. 1 as it is the lower end).

Figure 2:
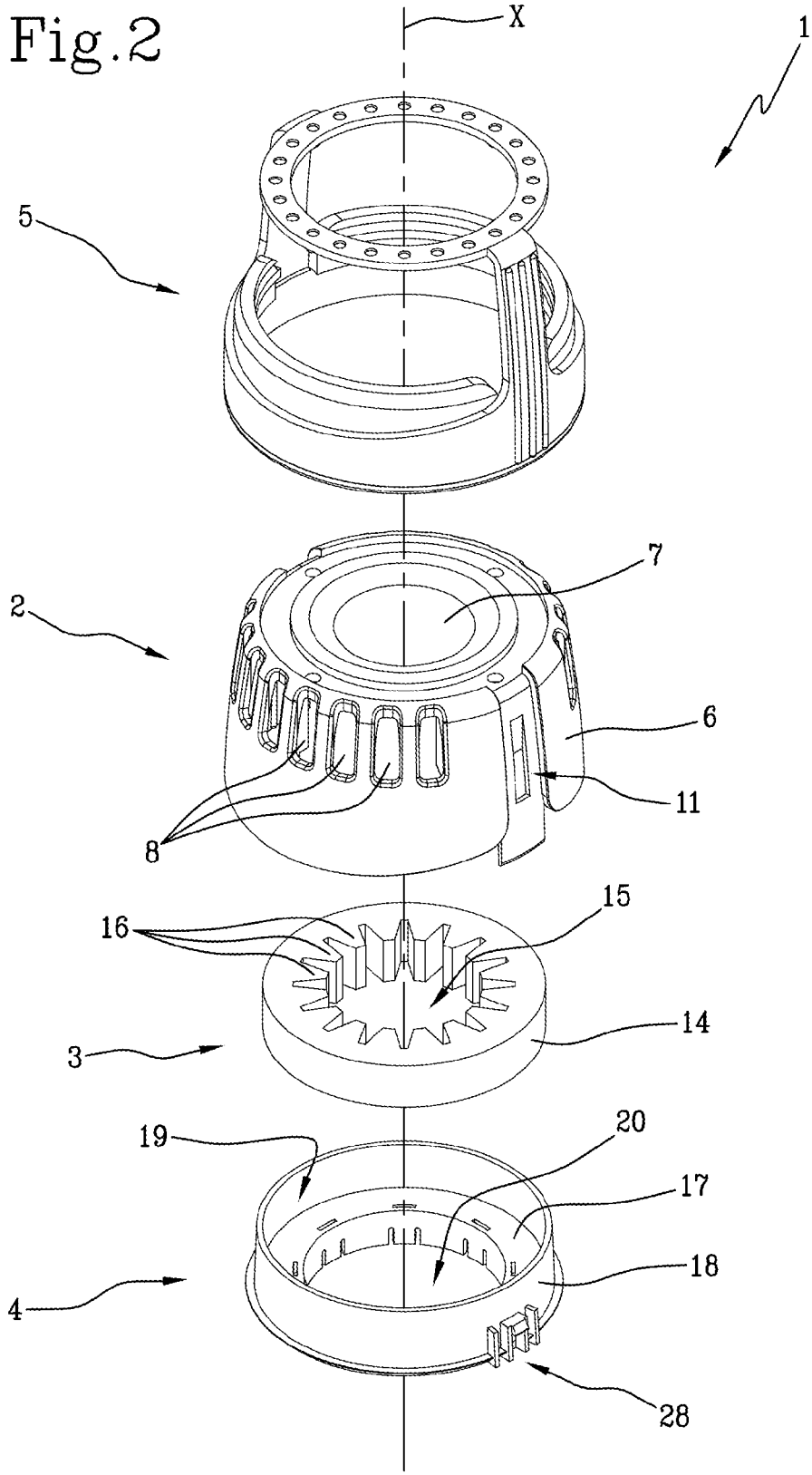
FIG. 2 is an exploded perspective view of the device of FIG. 1.

In the view of FIG. 2, the silencer device 1 comprises a container structure 2, in which attenuating means 3 are inserted, and a support element 4 provided such as to block the attenuating means 3 in a stable position internally of the container structure 2.

Figure 9:
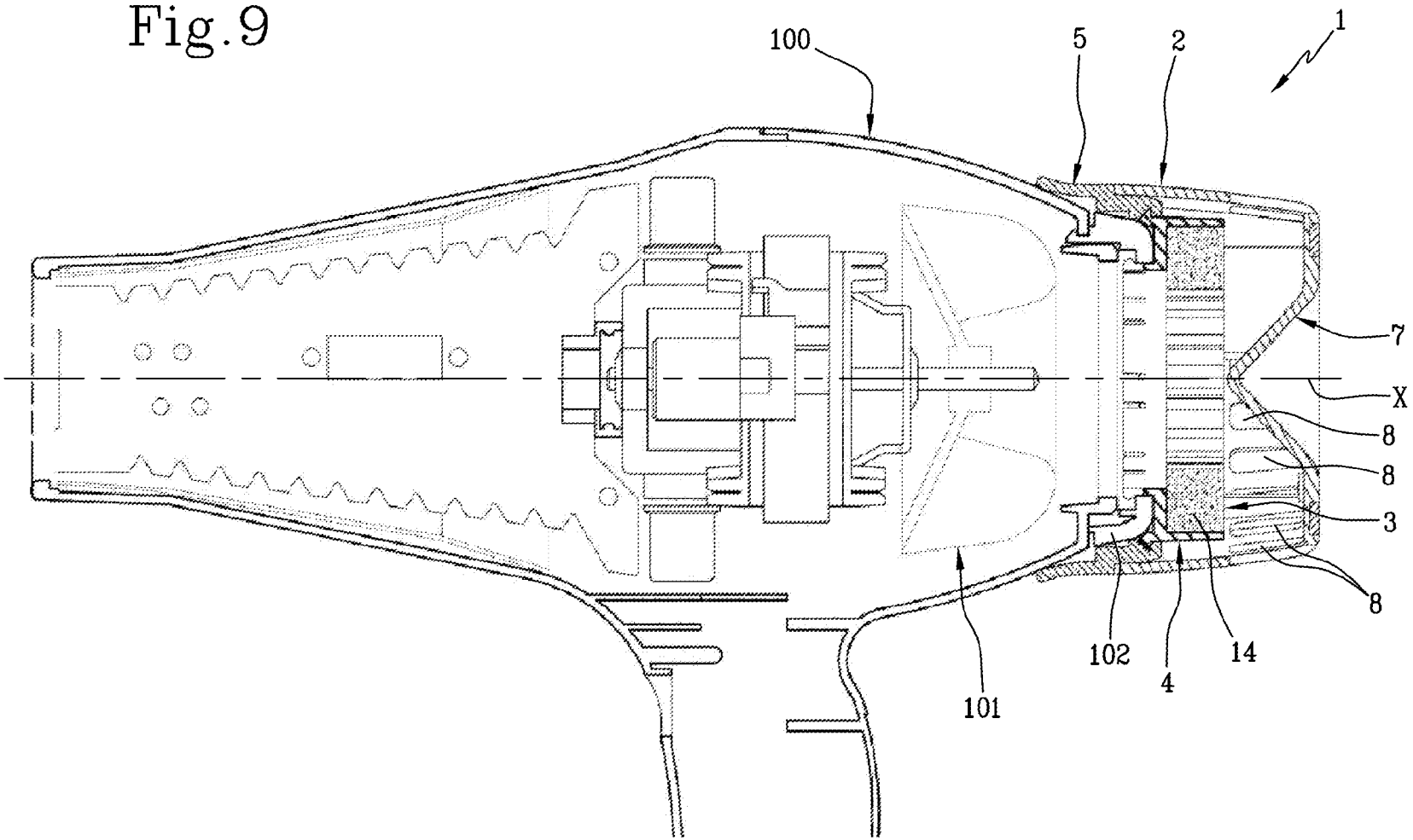
FIG. 9 is a section view of the device of FIG. 1 coupled with a hair-dryer.

The silencer device 1 further comprises an external body which at least partially envelops the container structure 2. The external body 5 is preferably made of a rubbery material and has the function of realizing a sealed connection of the silencer device 1 to a hair dryer (FIG. 9).

In more detail, the container structure 2, as visible in FIG. 2, exhibits a lateral wall 6 having the above-mentioned tapered shape, and a bottom wall 7 connected to the lateral wall 6 to close the mentioned first end 1*a* of the device 1.

The whole container structure 2, and in particular the lateral wall 6, develops substantially axial-symmetrically about an axis "X" which, once the silencer device 2 is applied to the hair-dryer 100, is parallel or coincides with the direction of the air flow in aspiration by the fan 101 of the hair dryer 100.

The bottom wall 7 is therefore arranged transversally, preferably perpendicular, to the axis "X".

The container structure 2 exhibits at least an inlet opening 8, an outlet opening 9 and a conduit 10 connecting the inlet opening 8 and the outlet opening 9.

In the embodiment illustrated in FIG. 1, the container structure 2 exhibits a plurality of inlet openings 8 distributed about the axis "X". The openings 8 are arranged in two diametrically-opposite groups together defining two recesses 11 that are diametrically opposite and destined to be coupled, by interference or joint, with the rubbery external body 5.

The inlet openings 8 advantageously face the axis "X" such as to define an air flow along a first transversal direction, and preferably a substantially perpendicular direction to the axis "X" itself.

In other words, the inlet openings have a transversal lie, or a substantially perpendicular lie, to the above-mentioned first direction, i.e. they are destined to enable a passage of an air flow which, when perpendicularly crossing the inlet openings 8 themselves, is directed towards the axis "X".

In more detail, the mentioned inlet openings 8 are made on the lateral wall 6 of the container structure 2, preferably in a position that is adjacent to the bottom wall 7.

In accordance with the embodiment illustrated in FIGS. 1 and 2, the inlet openings 8 are elongate in the direction of the axis "X" and are preferably rectangular or substantially rectangular. Thus they are adjacent to one another along a larger side thereof.

The outlet opening 9, on the other hand, has a perpendicular lie to the axis such as to realise, in outlet from the silencer device 1, an axial air flow along the axis "X".

The inlet openings 8 are arranged in proximity of or at the first end 1*a* of the silencer device 1, while the outlet opening 9 is arranged at the other end 1*b* of the silencer device 1.

Further, the silencer device 1 advantageously comprises deviating means 12, active internally of the conduit 10 such as to impress, on the air flow coming from the inlet openings 8, a deviation along a second less angled direction with respect to the axis "X" of the first direction, i.e. defining an angle with the axis "X" which is smaller than the angle defined between the first direction and the axis "X".

The mentioned deviating means 12 comprise a deviator wall 13 that is transversal to the above-mentioned first direction and which at least partly defines the bottom wall 7.

In accordance with the embodiment illustrated in FIGS. 5-7 and 9, the deviator wall 13 has a conical shape with a convexity facing towards the conduit 10 and is preferably axial-symmetric with respect to the axis "X".

Further, the inlet openings are advantageously directly facing the deviator wall 13. In this way, the air flow coming from the inlet openings 8 is channeled by the deviator wall 13 along the axis "X" towards the outlet opening 9.

As already mentioned, the sound-attenuating means 3 are housed internally of the container structure (and in particular internally of the conduit 10).

In accordance with the present invention, the attenuating means are inserted internally of the conduit 10 in such a position as to interfere with an air flow flowing from the inlet openings 8 towards the outlet opening 9 in such a way as to at least partly attenuate the sound vibrations of the air flow.

The lateral openings located on the circumference of the silencer, together with the central cone and the chamber 21, force the entering air entrained by the fan to follow a compulsory pathway before being sucked in by the fan itself towards the central body of the hair dryer, without causing swirling or obstacles between the entering air and the draught air produced by the fan.

The whole volume of air created is directed in its compulsory pathway towards the sound-absorbent material which attenuates the impact and significantly dampens the noise thanks also to the special configuration thereof with radial points directed towards the centre of the conduit, which offer a greater contact surface to the air passage.

The attenuating means 3 preferably comprise a ring 14 made of a sound-absorbent material exhibiting a central hole 15 which exhibits a plurality of radial protrusions 16 that are reciprocally angularly equidistanced.

The ring 14 is arranged such as to be centred on the axis "X", i.e. in such a way that the ring 14 is substantially axial-symmetric with respect to the axis "X".

The ring 14 is held in position, internally of the conduit 10, by means of the above-mentioned support element 4.

FIGS. 12-17 illustrate various embodiments of the ring 14.

The support element 4 is substantially annular, exhibiting an annular base 17 from which a peripheral border 18 perpendicularly departs, defining, in cooperation with the annular base 17, a seating 19 having an annular shape for housing the sound-absorbent ring 14.

The annular base 17 exhibits a central hole 20 for passage of the axial flow of air close to reaching the outlet opening 9.

In a mounted configuration of the support element 4, the seating 19 is thus arranged between the deviating means 12 and the outlet opening 9.

The annular base 17 and the border 18 preferably develop circumferentially, i.e. extending along a whole angular development about the axis "X".

Advantageously, in a mounted configuration of the support element 4, a chamber 21 is preferably afforded between the border 18 and the lateral wall 6 of the container structure 2, which chamber 21 has an annular shape and is in fluid communication with the conduit 10, the function of which is to control any swirling that might develop in the conduit 10, contributing to preventing the forming of swirlings, and to de-couple the border 18 from the lateral wall 6 and, therefore, reduce the vibrations transmitted there-between.

Special blocking means 22 can be provided on the container structure 2 to stably retain the ring 14 internally of the annular seating 19. In the assembled configuration of the silencer device 1, the blocking means 22 abuttingly receive corresponding portions of the ring 14, thus preventing movement thereof with respect to the seating 19.

Figure 5A:
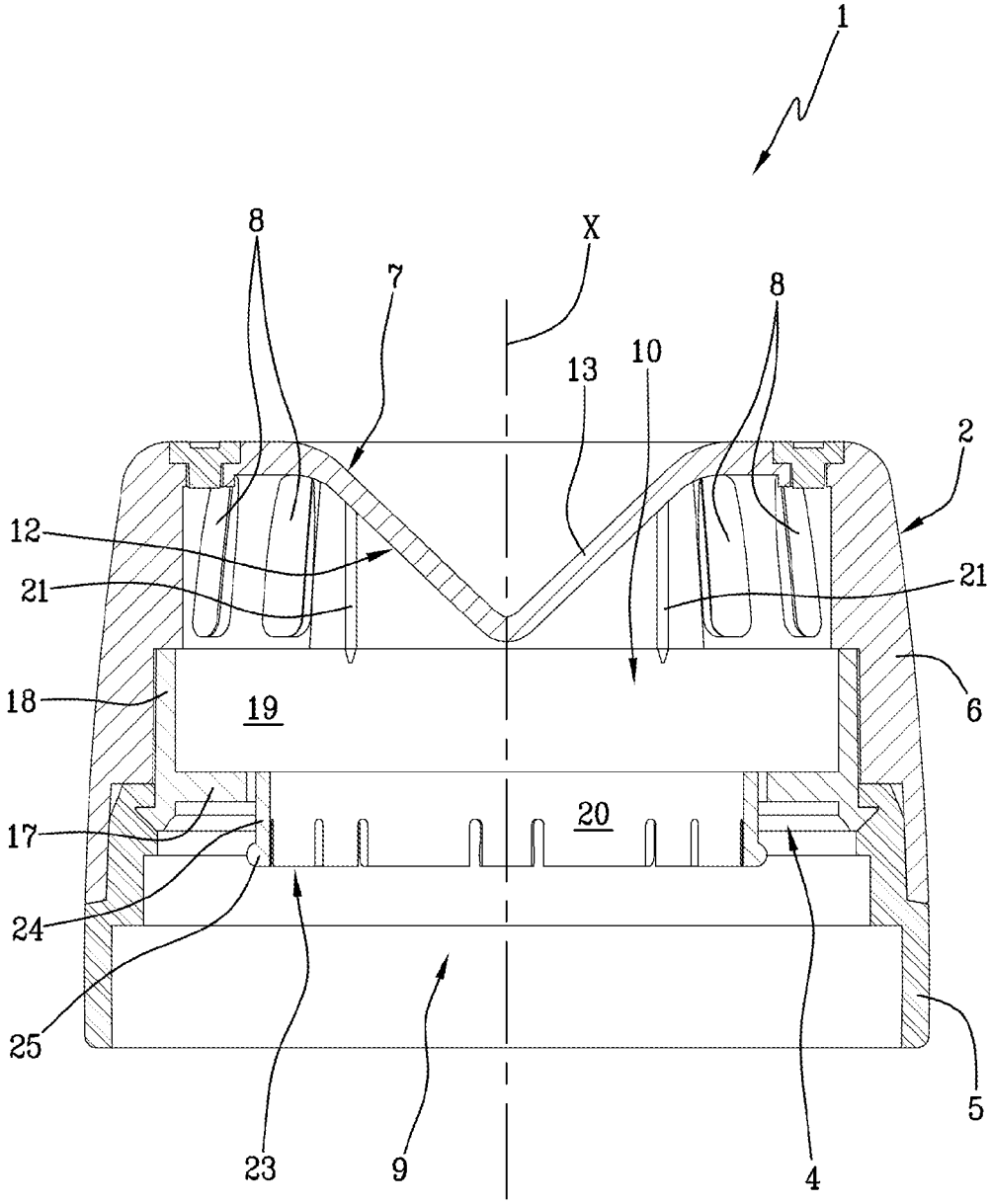
FIG. 5A is a section view of the device of FIG. 4 according to directrix line V-V and with some parts removed better to evidence others.
Figure 5B:
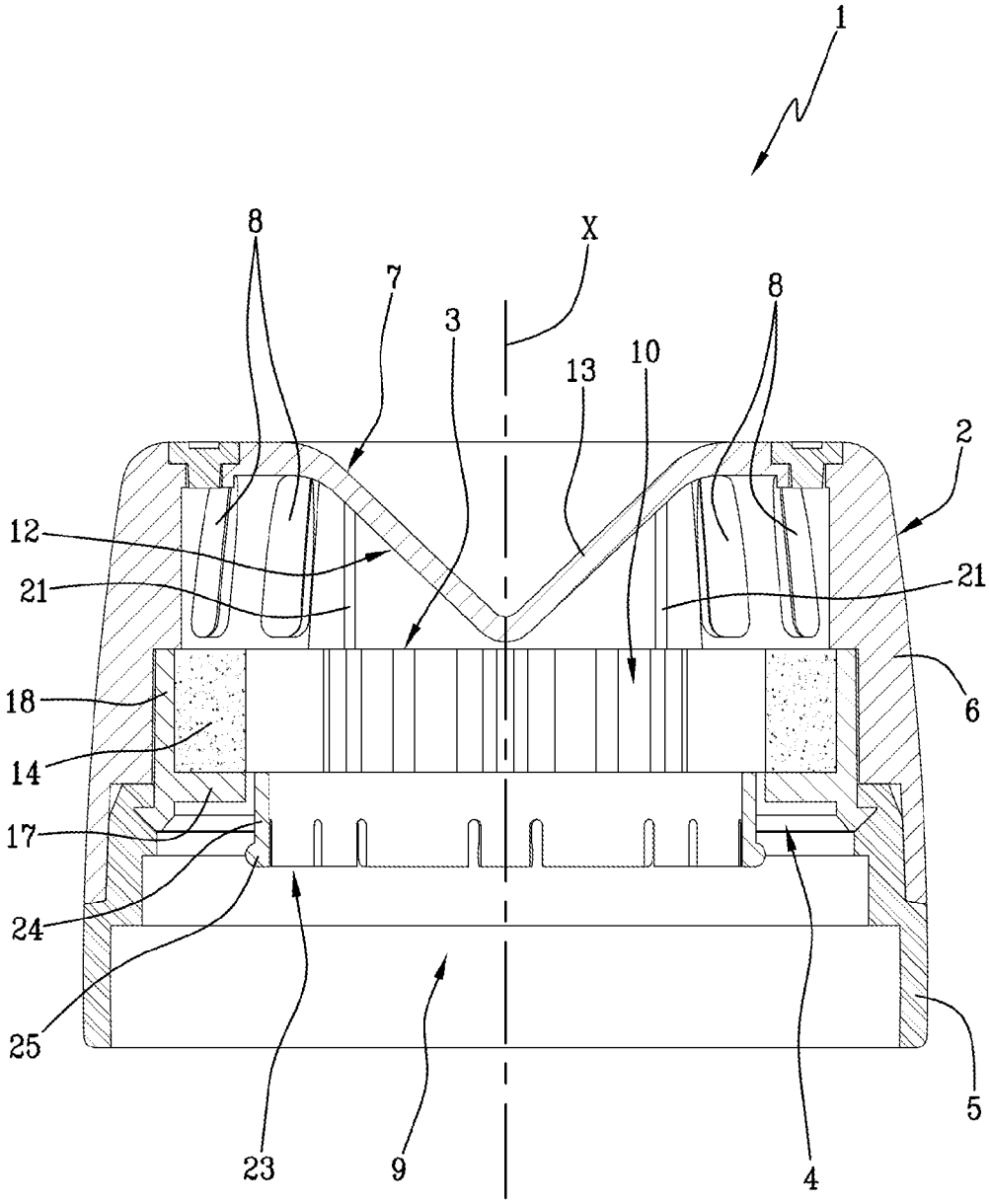
FIG. 5B is a section view of the device of FIG. 4 according to directrix line V-V and in a complete configuration.
Figure 6:
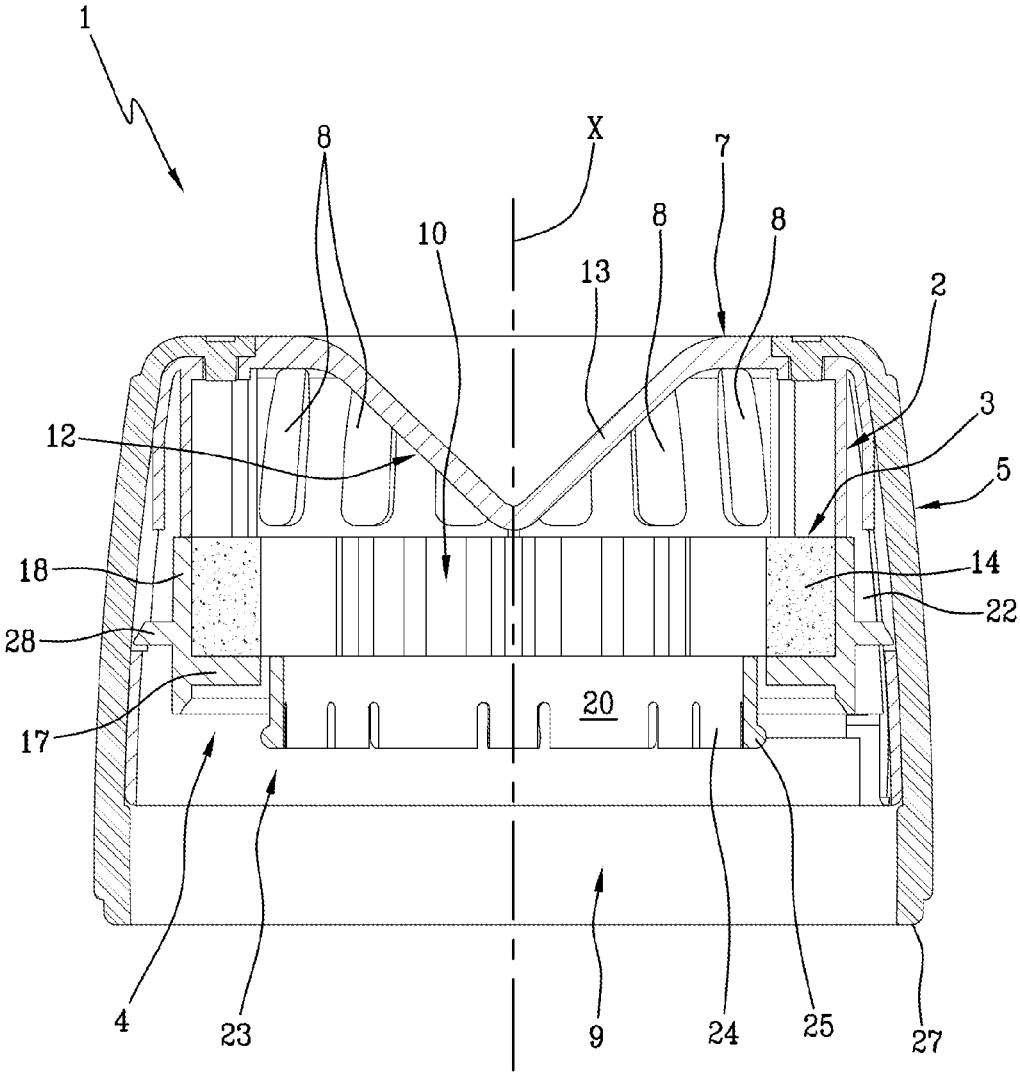
FIG. 6 is a section view of the device of FIG. 4 according to directrix line VI-VI.
Figure 7:
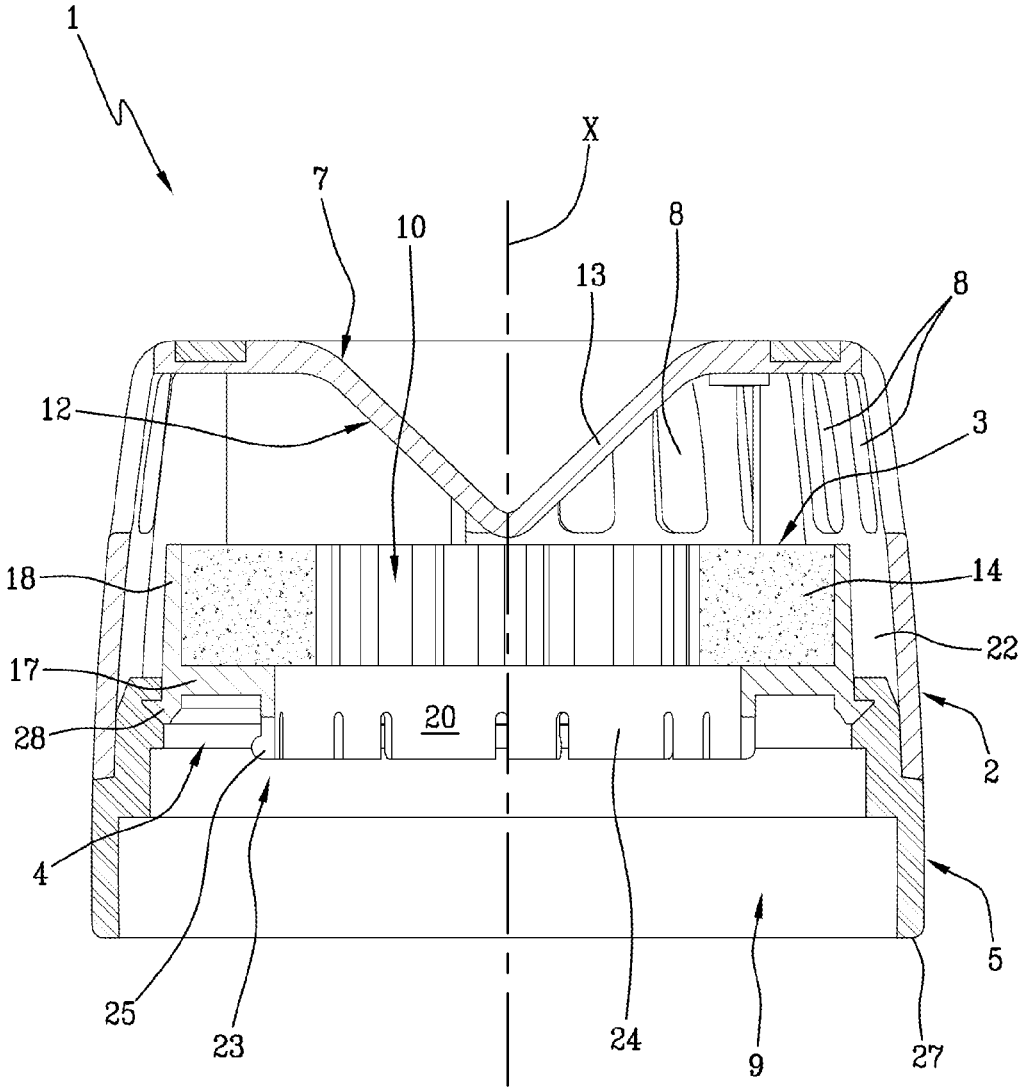
FIG. 7 is a section view of the device of FIG. 4 according to directrix line VII-VII.
Figure 8:
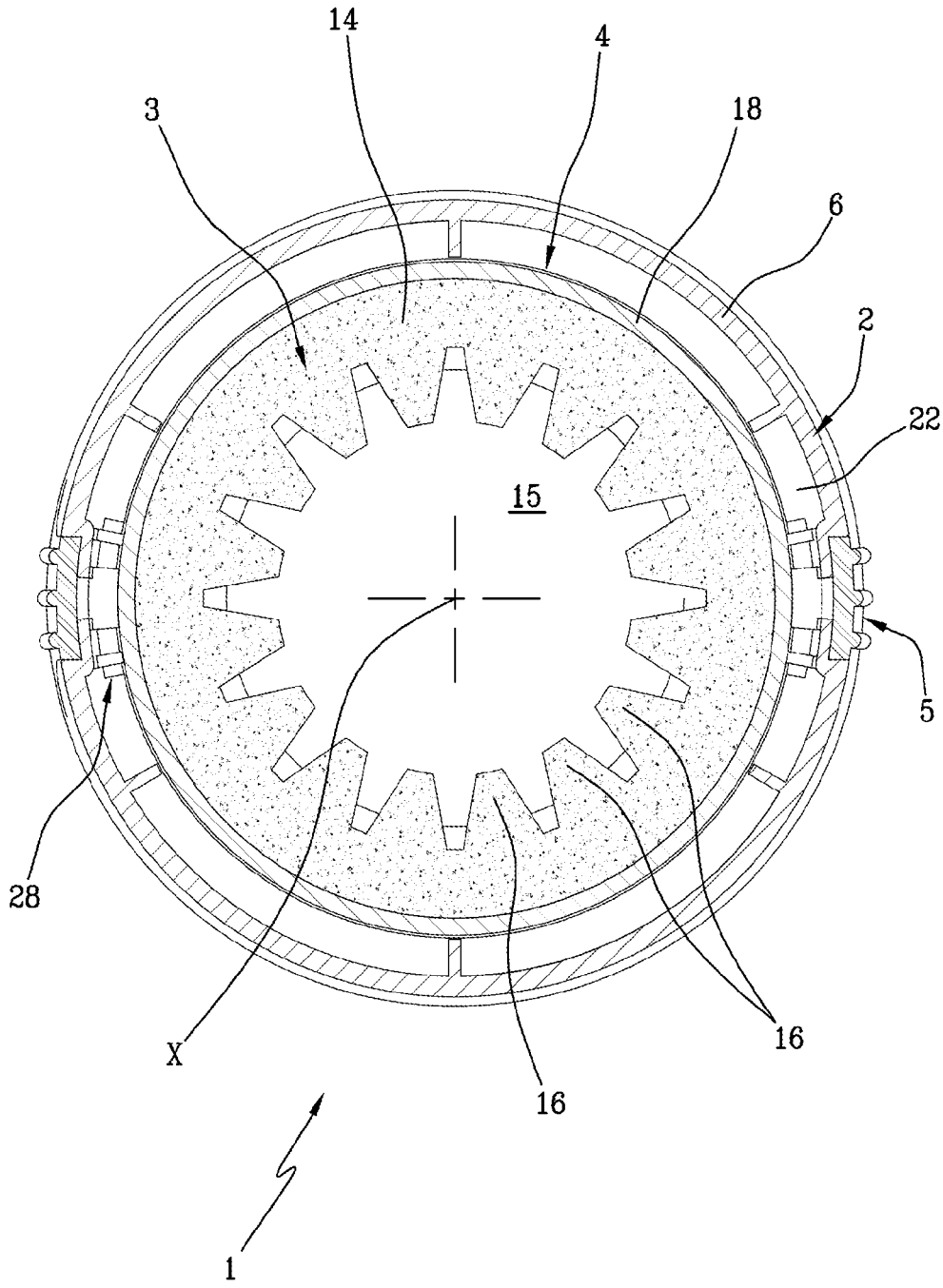
FIG. 8 is a section view of the device of FIG. 4 according to directrix line VIII-VIII.

In the embodiment of FIGS. 5A and 5B, the blocking means 22 comprise one or more axial broadenings extending from the bottom wall 7 (for example from the deviator wall 13) along the axis "X" and being of such a length as to reach the position assumed by the ring 14 in the assembled configuration (FIG. 5B).

The support element 4 is stably couplable to the container structure 2 by means of snap-joints, for example tabs 28.

At the position of the central hole 20, the support element 4 can exhibit a coupling flange 23 for realising a stable coupling with a hair dryer 100. The flange 23 can comprise, for example, a cylindrical portion 24 extending distancingly from the annular base 17 in an opposite direction with respect to the border 18, and one or more radial projections 25 extending distancingly from the cylindrical portion 24 such as to realise a connection with a corresponding attaching border 102 of the hair dryer 100.

As previously described, the presence of the rubbery external body 5 enables adequate fluid seal between the hair dryer 100 (and in particular the rear aspirating section thereof) and the silencer device 1, such that the depression generated by the fan 101 of the hair dryer 100 can be transmitted up to inside the conduit 10 of the silencer device 1.

The sealed coupling can be guaranteed by a deformable attachment edge 27 realised at an end of the rubbery external body 4, destined to couple with the hair dryer 100.

With reference to the reduction effect on the emitted noise, the Applicant has found that where the axial dimension (i.e. along the axis "X") of the inlet openings 8 is substantially equal to the axial dimension of the deviator wall 13, the noise reduction effect is optimal.

Figure 10A:
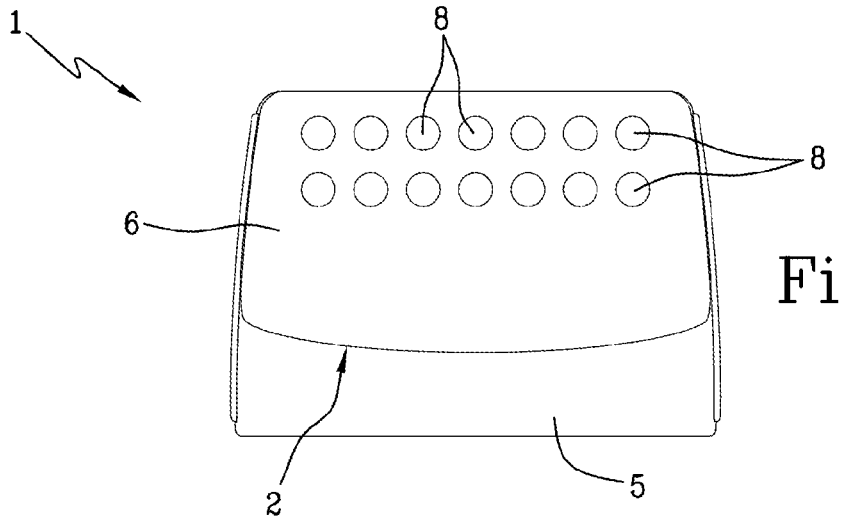
FIGS. 10A-10C are lateral views of a silencer device according to the present invention and in accordance with further different embodiments.
Figure 10B:
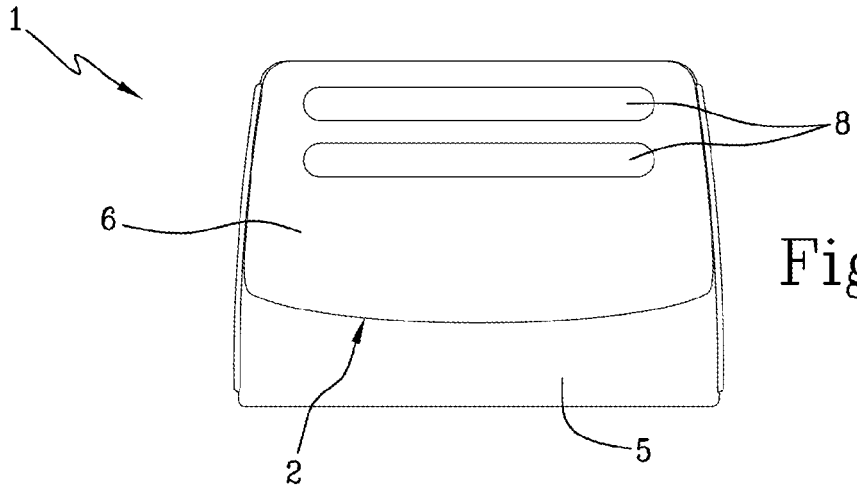
Figure 10C:
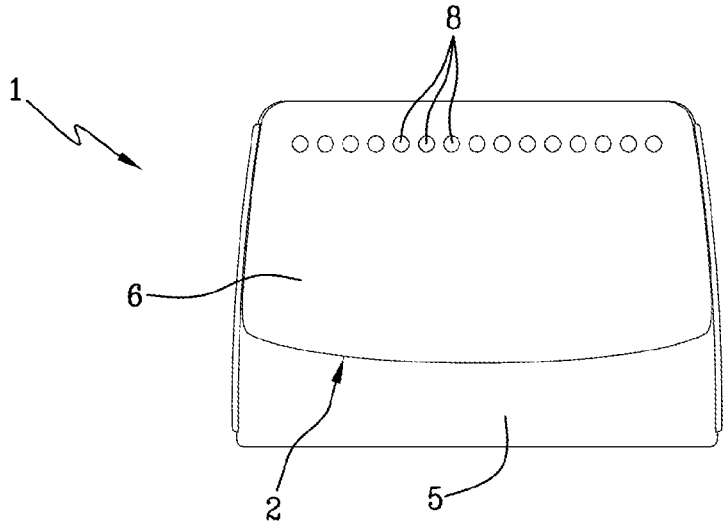

In accordance with FIGS. 10A-10C illustrate lateral views of different embodiments of the silencer device 1.

In FIG. 10A, the inlet openings 8 are circular and arranged on two distanced parallel lines along the axis "X".

In accordance with FIG. 10B, the inlet openings 8 have an elongate shape perpendicular to the axis "X", i.e. along an angular development about the axis "X". The inlet openings 8 are preferably two pairs, the two pairs being arranged in a diametrically opposite position with respect to the axis "X" and the two openings 8 of each pair being spaced along the axis "X".

In accordance with FIG. 10C, the inlet openings 8 are circular and arranged on a single line about the axis "X".

Figure 11A:
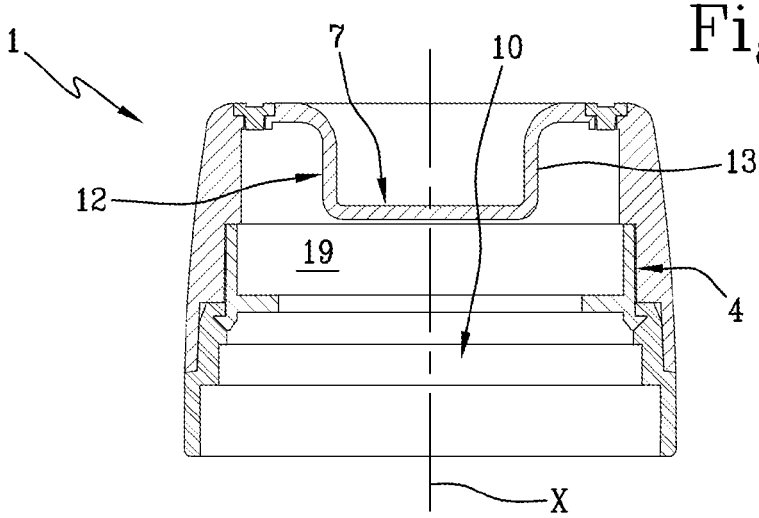
FIGS. 11A-11C are section views, respectively, of the devices of FIGS. 10A-10C, according to directrice lines as in FIGS. 5A, 5B.
Figure 11B:
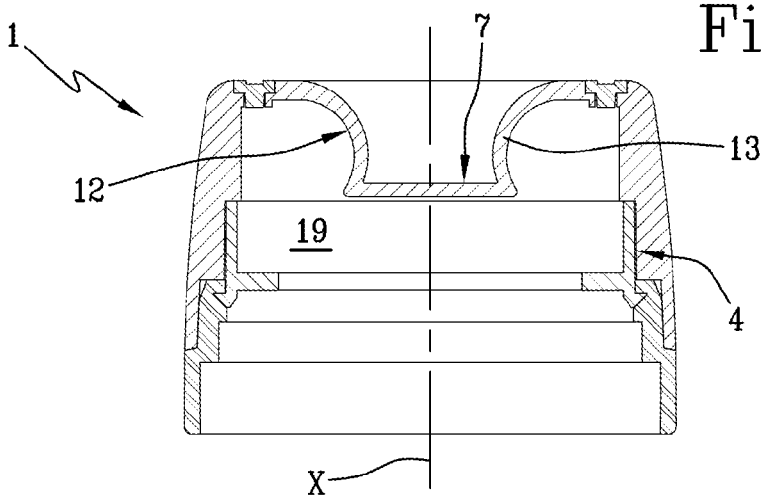
Figure 11C:
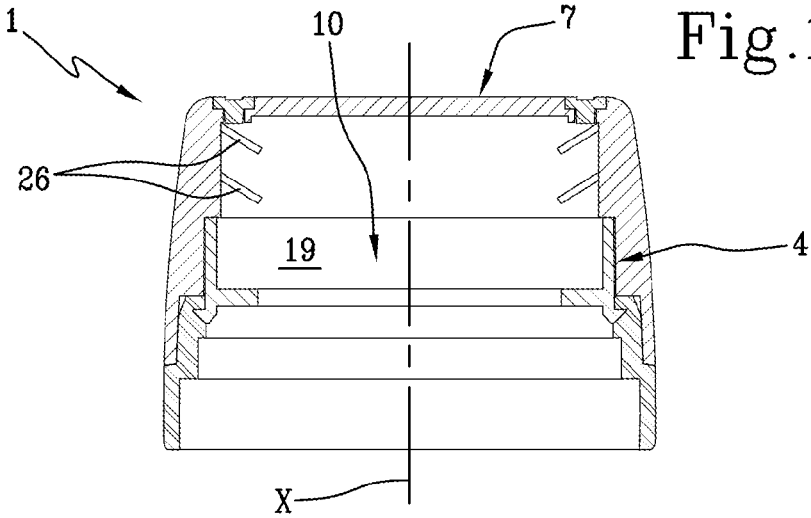
Figure 16:
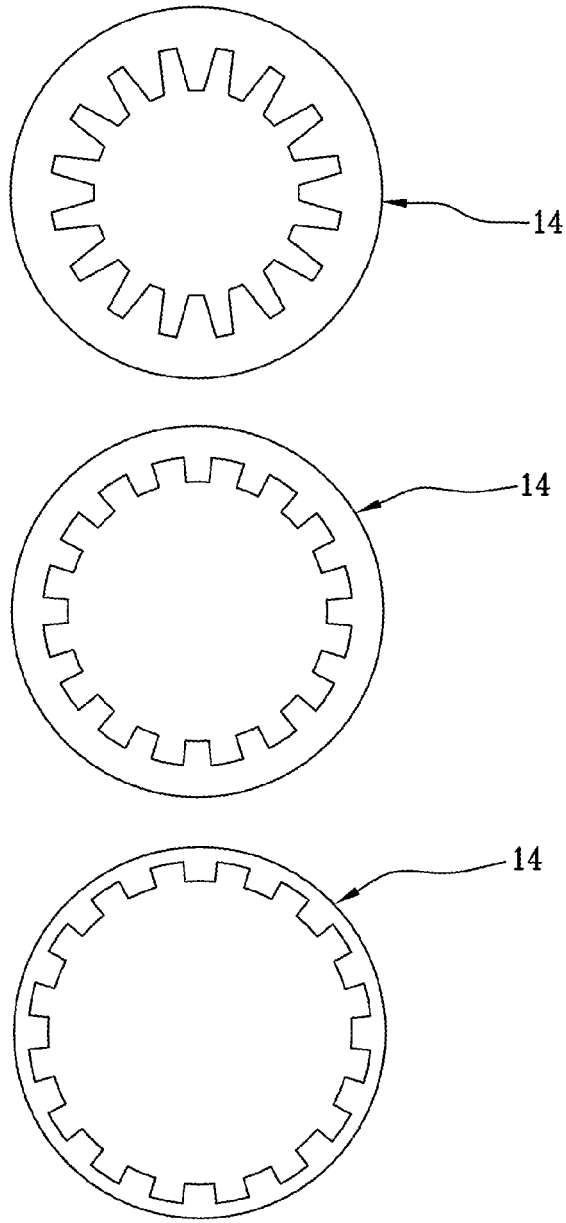
FIG. 16 illustrates a further embodiment of the ring which is made by stacking of three slim rings exhibiting different internal profiling.
Figure 17:
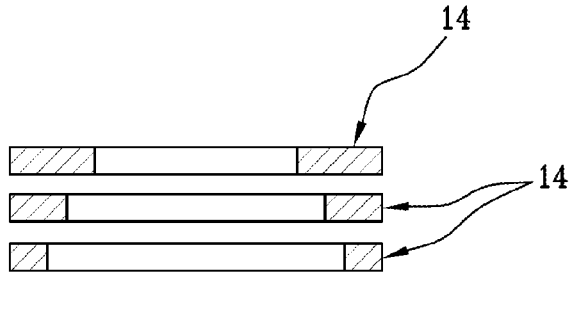
FIG. 17 illustrates a section according to a common diameter plane of the three slim rings of FIG. 16.

FIGS. 11A-11C show section views of different embodiments of the silencer device 1.

In accordance with FIG. 11A, the deviating means 12 are defined by a cylindrical wall which, in section along a plane passing through the axis "X" (as in FIG. 11A), has a substantially rectangular section, possibly with beveled or connected edges.

In accordance with FIG. 11B, the deviating means 12 are defined by a concave wall that is substantially axial-symmetric about the axis "X", the concavity of the wall facing the inlet openings 8.

In accordance with FIG. 11C, the deviating means 12 are defined by a pair of deflectors 26, extending from the lateral wall 6 of the container structure 2 towards the axis "X" and inclined towards the attenuating means 3 such as to realise the mentioned deviating action of the flow entering through the inlet openings 8.

This latter configuration of the deviating means 12 is suitable for inlet openings 8 arranged in configurations of the type illustrated in FIGS. 10A and 10B, i.e. with two lines of openings 8 distanced along the axis "X".

The present invention attains the set aims.

The special configuration of the silencer device, with the inlet openings arranged on the lateral openings and the deviating means for deviating the air coming from the lateral openings towards the axial direction and, therefore, towards the attenuating means, has been shown to be effective in reducing the noise emitted by the hair dryer. This occurs because the means set up with the introduction of the silencer: air inlet openings and their position, central cone, chamber 21, sound-absorbent body, all prevent formation of the air swirling phenomena which can be produced on activation of the fan—between entrained air from outside towards the inside, through the filter, and air generated by the movement of the fan—and absorb the majority of the noise produced by the passage of air.

Further, the special geometry of the sound-absorbent ring, exhibiting the above-mentioned radial protrusions facing towards the axis, contribute significantly to the reduction of the sound emitted. Sound-absorbent material with a special shape/configuration—ring with internal surface, radial points—has been selected because this type of projection offers a very large sound-reducing surface to the passage of the air and, thanks also to the ring shape, offers no obstruction to air passage.

The position of the sound-absorbent ring, together with the air deviator/channeling cone, is designed such that the air immediately encounters the sound-absorbent material which reduces the noise and channels it towards the inside of the hair dryer.

The result is a greater reduction in noise with respect to devices of the prior art, which exploit an axial aspiration through openings realised on the bottom wall.

This improvement, among other things, is obtained without a corresponding increase in power absorbed and, indeed, the special structure of the silencer device of the invention leads to less power wastage with respect to traditional systems.

This produces a benefit in terms of acoustic comfort in use, as well as an applicability to hair dryers of professional type where the absorbance of power on the part of the silencer device does not have a negative effect on the performance of the hair dryer.

The invention claimed is:

1. A silencer device for a hair dryer, comprising:

a container structure (2) developing about an axis (X) and exhibiting at least an inlet opening (8), and an outlet opening (9) and a conduit (10) connecting the inlet (8) and outlet (9) openings to one another;

attenuating means (3), inserted internally of the conduit (10) for interfering with a flow of air between the inlet opening (8) and the outlet opening (9) in such a way as to at least partly attenuate sound vibrations associated to the air flow;

wherein the container structure (2) comprises a lateral wall (6), developing about the axis (X), and a bottom wall (7) arranged transversally of the axis (X) and connected to the lateral wall (6), and wherein the inlet opening (8) is realized on the lateral wall (6);

the inlet opening (8) facing the axis (X) and defining an air flow direction along a transversal direction to the axis (X), and in that the silencer device (1) further comprises deviating means (12), the deviating means (12) at least partially defining the bottom wall (7) or projecting from the bottom wall (7), the deviating means (12) comprising a deviator wall (13) which projects sufficiently into the conduit (10) so that incoming air flowing along the air flow direction will be effectively aimed towards and into the deviator wall (13) and redirected into a direction through the outlet opening (9).

2. The device of claim 1, wherein the deviator wall (13) extends about the axis (X) and wherein the container structure (2) exhibits a plurality of inlet openings (8) distributed about the axis (X), each inlet opening (8) defining an air flow direction aimed towards and into the deviator wall (13).

3. The device of claim 2, wherein the deviator wall (13) has a conical shape having a convexity facing towards the conduit (10).

4. The device of claim 3, wherein the deviator wall (13) is axially symmetric about the axis (X).

5. The device of claim 2, wherein the deviator wall (13) extends about the axis (X) over a whole angular development thereof.

6. The device of claim 1, wherein the outlet opening (9) has a transversal lie in relation to the axis (X), in order to realise a flow of axial air along the axis (X) in outlet from the silencer device (1).

7. The device of claim 6, wherein the outlet opening (9) has a perpendicular lie in relation to the axis (X).

8. The device of claim 1, further comprising a support element (4) which is stably couplable to the container structure (2) at the outlet opening (9) and which exhibits a seating (19) for containing the attenuating means (3).

9. The device of claim 8, further comprising an external body (5) having an attaching edge (27) which is deformable such as to enable a sealed coupling with a hair-dryer (100), the container structure (2) being stably connectable to the external body (5).

10. The device of claim 9, wherein the external body (5) is rubbery.

11. The device of claim 9, wherein the container structure (2) is stably connectable to the external body (5) by means of reciprocal insertion.

12. The device of claim 1, wherein the attenuating means (3) comprise a ring (14) made of a sound-absorbent material which exhibits a central hole (15) a profile of which ring (14) exhibits a plurality of radial protrusions (16) which are angularly arranged to one another.

13. The device of claim 1, wherein the attenuating means (3) comprise a ring (14) made of a sound-absorbent material which exhibits a central hole (15) a profile of which ring (14) exhibits a plurality of radial protrusions (16) which are angularly arranged to one another, and wherein a chamber (22) is afforded between the ring (14) made of a sound-absorbent material and the lateral wall (6) of the container structure (2), which chamber (22) is placed in fluid communication with the conduit (10) for controlling possible air swirls and/or possible vibrations transmitted from the ring (14) to the lateral surface (6).

14. The device of claim 1, wherein said tranversal direction to the axis (X) is substantially perpendicular to the axis (X).

15. The device of claim 1, wherein the inlet opening (8) is realized on the lateral wall (6) in an adjacent position to the bottom wall (7).

16. The device of claim 1, wherein the deviating means (12) is a single projection which projects into the conduit (10).

* * * * *